US008656541B2

(12) United States Patent
Muollo

(10) Patent No.: US 8,656,541 B2
(45) Date of Patent: Feb. 25, 2014

(54) INFLATABLE BED

(76) Inventor: Gianna Muollo, Vaucluse (AU)

( * ) Notice: Subject to any disclaimer, the term of this patent is extended or adjusted under 35 U.S.C. 154(b) by 140 days.

(21) Appl. No.: 12/596,807

(22) PCT Filed: Mar. 25, 2008

(86) PCT No.: PCT/AU2008/000417

§ 371 (c)(1),
(2), (4) Date: Jan. 24, 2011

(87) PCT Pub. No.: WO2008/113138

PCT Pub. Date: Sep. 25, 2008

(65) Prior Publication Data

US 2011/0107522 A1 May 12, 2011

(30) Foreign Application Priority Data

Mar. 21, 2007 (AU) ..... 2007901438

(51) Int. Cl.
*A47C 16/00* (2006.01)

(52) U.S. Cl.
USPC ..... 5/735; 5/615; 5/631; 5/713; 5/655.3

(58) Field of Classification Search
USPC ..... 5/615, 631, 713, 735, 655.3
See application file for complete search history.

(56) References Cited

U.S. PATENT DOCUMENTS 3,988,793 A * 11/1976 Abitbol ..... 601/11
4,054,960 A 10/1977 Pettit et al.
4,737,999 A * 4/1988 Halverson ..... 5/710
4,819,287 A * 4/1989 Halverson ..... 5/710
5,113,875 A 5/1992 Bennett
5,170,522 A * 12/1992 Walker ..... 5/615
5,173,979 A 12/1992 Nennhaus
5,185,897 A 2/1993 Van Laanen
5,237,712 A * 8/1993 Ramsay ..... 5/710
D342,409 S * 12/1993 Gambin ..... D6/596
5,412,824 A 5/1995 Emerson et al.
5,425,147 A 6/1995 Supplee et al.
5,438,715 A * 8/1995 Jackman ..... 5/110
D403,194 S * 12/1998 Thurston ..... D6/604
5,890,246 A 4/1999 Davis
6,568,015 B1 * 5/2003 Allen ..... 5/735
6,581,229 B2 * 6/2003 Bernstein ..... 5/722

(Continued)

FOREIGN PATENT DOCUMENTS

DE 3718331 12/1988
GB 258077 9/1926

OTHER PUBLICATIONS

Examination Report for GB0918387.2 (Mar. 7, 2012).
Examination Report for GB0918387.2 (Apr. 1, 2011).

*Primary Examiner* — William Kelleher
(74) *Attorney, Agent, or Firm* — Edwards Wildman Palmer LLP; Steven M. Jensen

(57) ABSTRACT

An inflatable bed system (1) includes a primary inflatable section (2) having a centrally located abdomen cavity shaped to allow a user's abdomen to be positioned therein. The system further includes a secondary inflatable section (3), which is independently inflatable and positioned inside the cavity. At least one tertiary inflatable section (15,22) is provided to allow further configuration of the bed. The bed may be inflated by a pump that is operatively connected with a valve which directs the movement of air into each of the inflatable sections under user selection.

20 Claims, 14 Drawing Sheets

(56) References Cited

U.S. PATENT DOCUMENTS

| | | | | |
|---|---|---|---|---|
| 6,739,005 | B2 * | 5/2004 | Davis | 5/615 |
| 6,761,604 | B1 | 7/2004 | Hronek | |
| 7,127,764 | B1 * | 10/2006 | Harding et al. | 5/735 |
| 2003/0196270 | A1 * | 10/2003 | Leventhal et al. | 5/660 |
| 2005/0188465 | A1 | 9/2005 | Fahey | |
| 2006/0162084 | A1 * | 7/2006 | Mezue | 5/706 |

* cited by examiner

INFLATABLE BED

FIELD OF THE INVENTION

The invention relates to inflatable air mattresses, particularly those designed to allow a pregnant woman to sleep or rest comfortably.

BACKGROUND

Specially designed and configured inflatable air mattresses for providing a comfortable and healthy resting or sleeping environment for pregnant women have a long history of development. As is well known, as a pregnancy progresses a woman's ability to find a comfortable resting position on conventional mattresses decreases significantly. In past years, this has led to the development of many types of mattresses having a suitably located central cavity to accommodate the distended abdomen. However, the degree and orientation of abdomen expansion changes dramatically over time, and a mattress with a more or less static cavity size, or other fixed attributes, cannot provide the needed comfort and other health benefits for the full range of development.

In recent years, air mattresses of various types have been proposed, some of which have moved the pregnancy mattress art in useful directions. The basic ability of a variably inflatable air mattress does allow for a certain amount of dynamic accommodation over time.

SUMMARY OF THE INVENTION

Disclosed is an inflatable bed system comprising a primary inflatable section, the primary inflatable mattress section having a centrally located abdomen cavity shaped to allow a user's abdomen to be positioned therein; a secondary inflatable section, the secondary section being independently inflatable and positioned inside the cavity; and at least one tertiary inflatable section.

In one form the at least one tertiary inflatable section is provided to allow for further flexibility in the configuration of the bed. In one form the tertiary inflatable section is positioned around at least a portion of the periphery of the cavity.

In a particular form the cavity is oval and the tertiary inflatable section comprises an oval loop.

In one form the at least one tertiary inflatable section is wedge-shaped and positioned at the foot of the bed to provide a leg rest to elevate the feet of a user.

In one form the bed system includes the wedge-shaped tertiary system in addition to a tertiary inflatable system to further configure the shape of the cavity.

In one form a surface layer is positioned above primary mattress section. In one form the surface layer extends over the primary inflatable mattress section and includes a surface cavity adapted to align with the abdomen cavity.

In one form the inflatable bed system further comprises a valve which directs the movement of air into each of the inflatable sections, and a pump operatively connected to the valve.

In one form the valve is adapted to direct air flow from the pump into a selected inflatable section upon selection of the inflatable section by a user. In one form the valve is controlled manually. In one form, the pump is activated by a remote control.

The inflatable bed system has the benefit of providing an inflatable bed with an abdominal cavity which is adapted to be adjusted in depth, firmness and diameter. In some forms the system allows a user to adjust the firmness and to significantly change the diameter of the cavity and the pressure at the periphery of the cavity. In some forms the system allows a user to adjust the position of their legs.

BRIEF DESCRIPTION OF THE DRAWINGS

In order that the invention may be more readily understood, preferred embodiments of it are described below with reference to the accompanying drawings, in which.

DETAILED DESCRIPTION OF PREFERRED EMBODIMENTS

Figure 1:
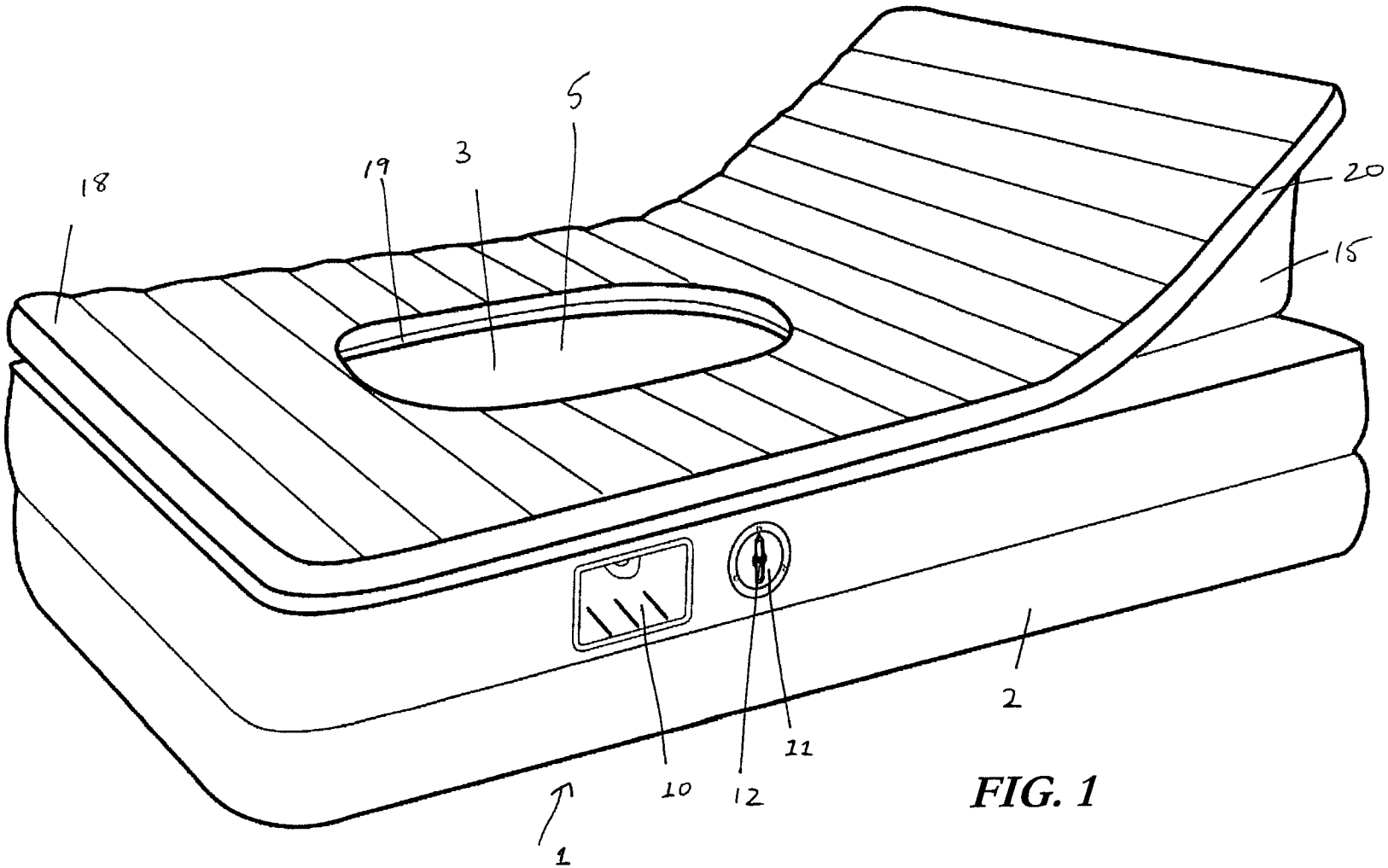
FIG. 1 is a perspective view of an inflatable bed system of one embodiment of the present invention.
Figure 2:
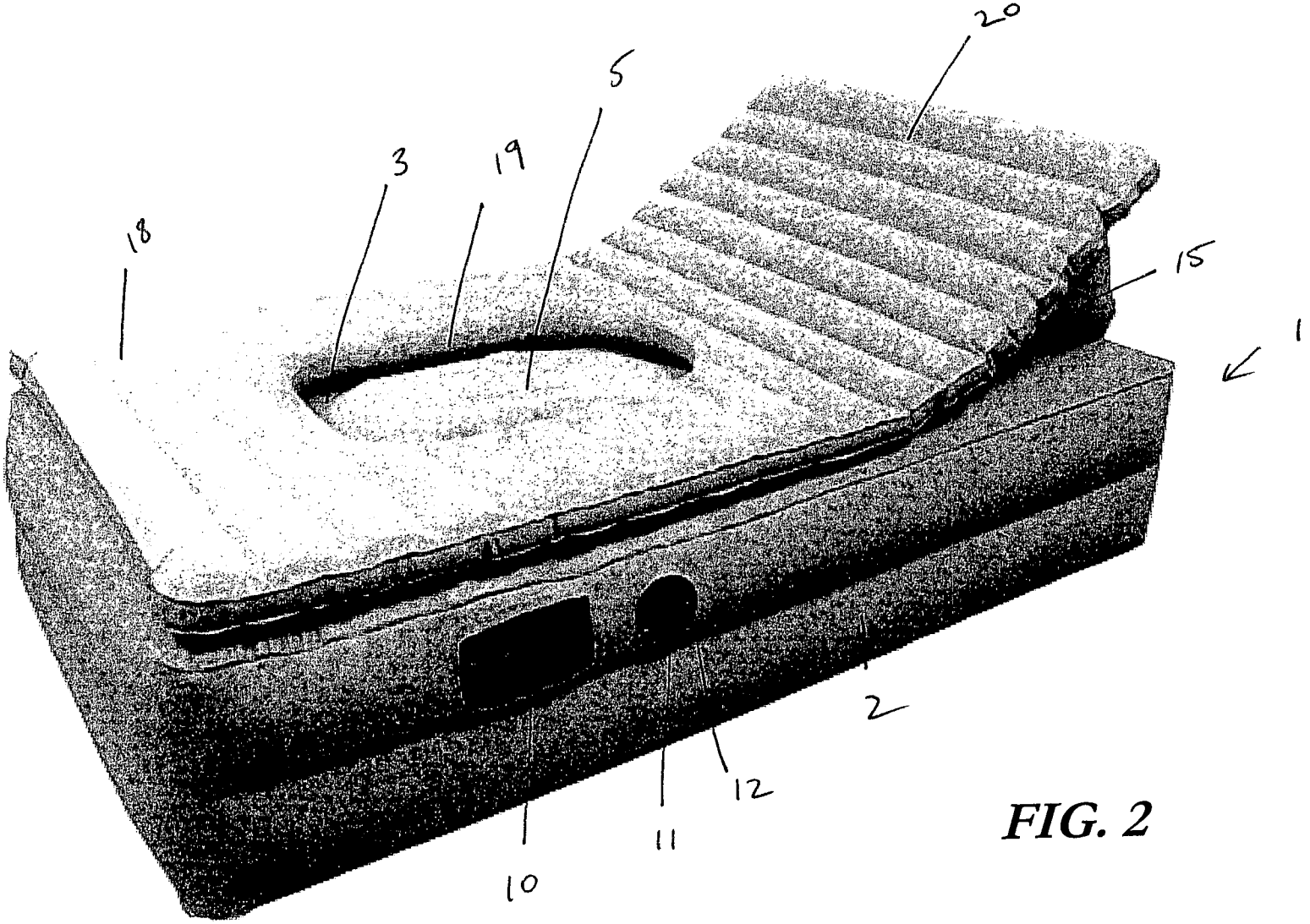
FIG. 2 is a perspective view of an inflatable bed system of one embodiment of the present invention.
Figure 3:
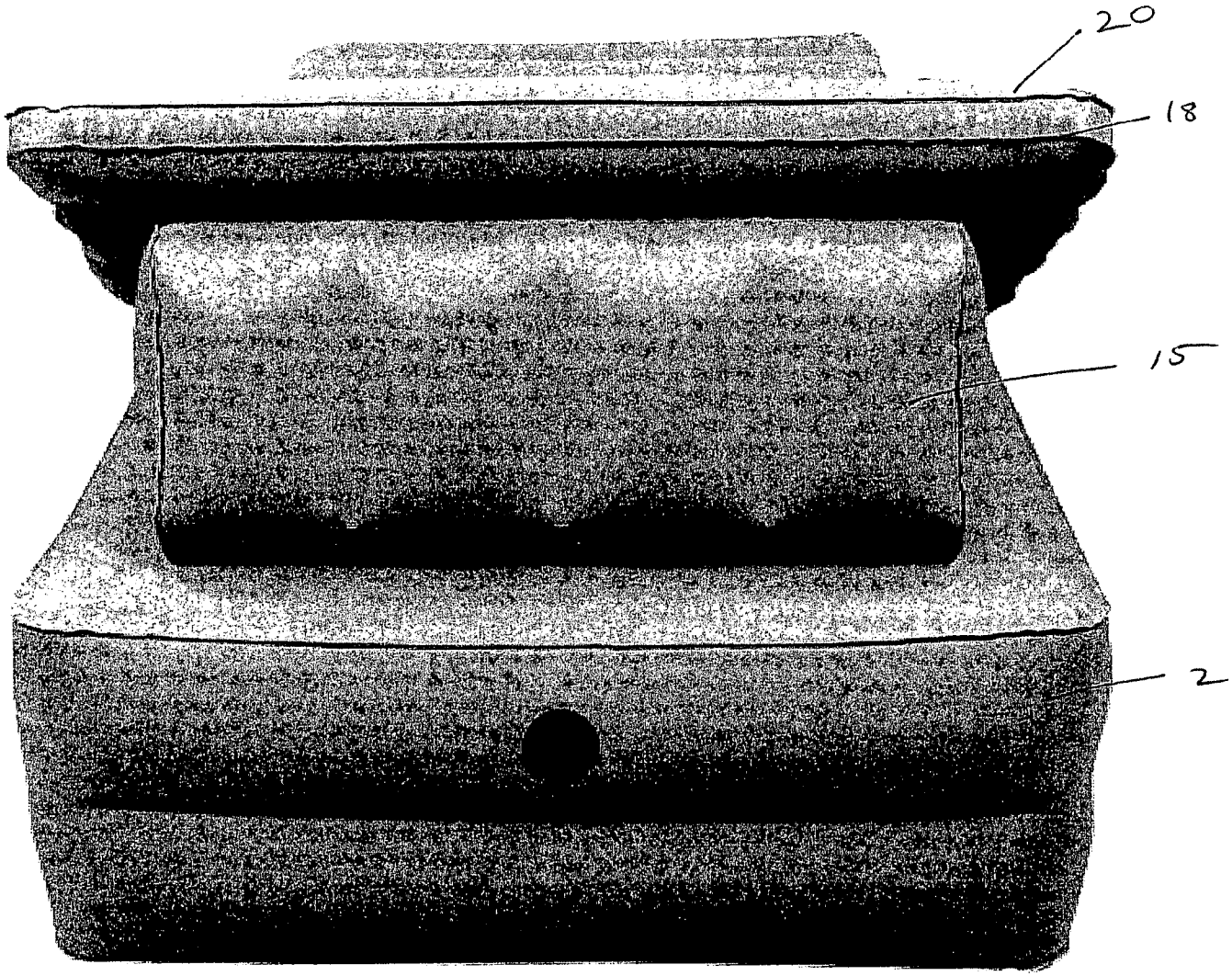
FIG. 3 is a top side view of the bed system of FIG. 2.
Figure 4:
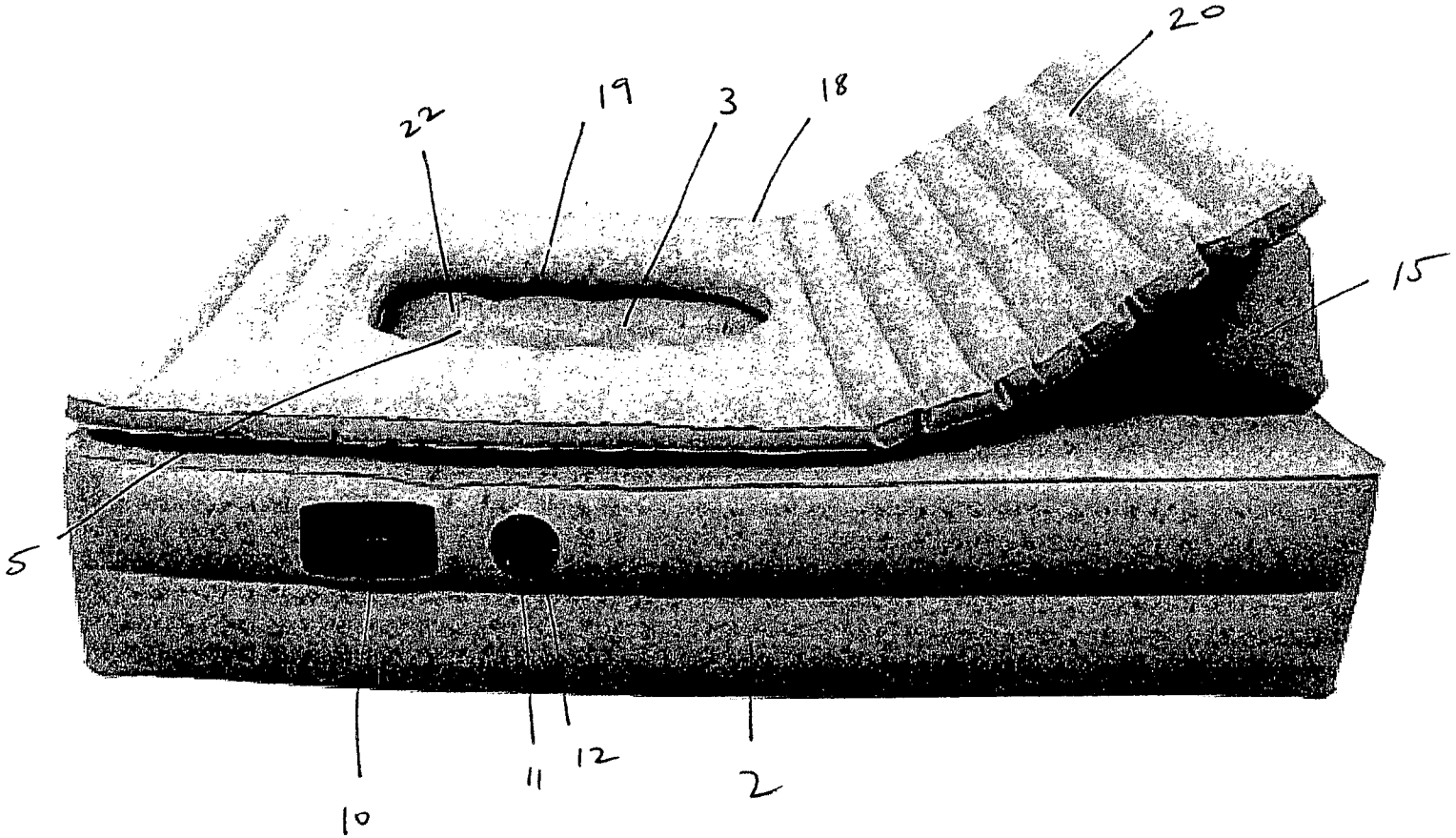
FIG. 4 is a side perspective view of the bed system of FIG. 2.
Figure 5:
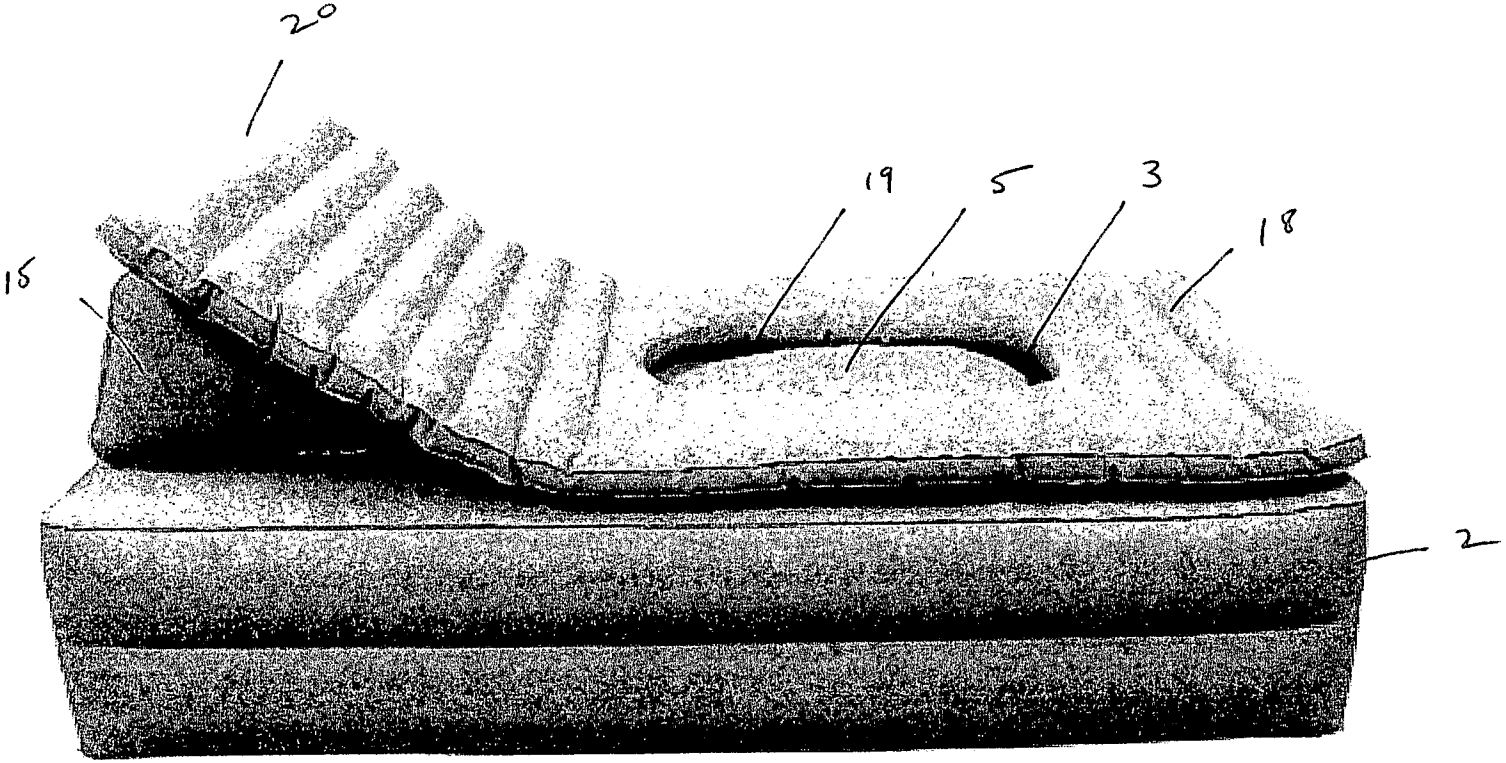
FIG. 5 is a side perspective view of the bed system of FIG. 2.
Figure 6:
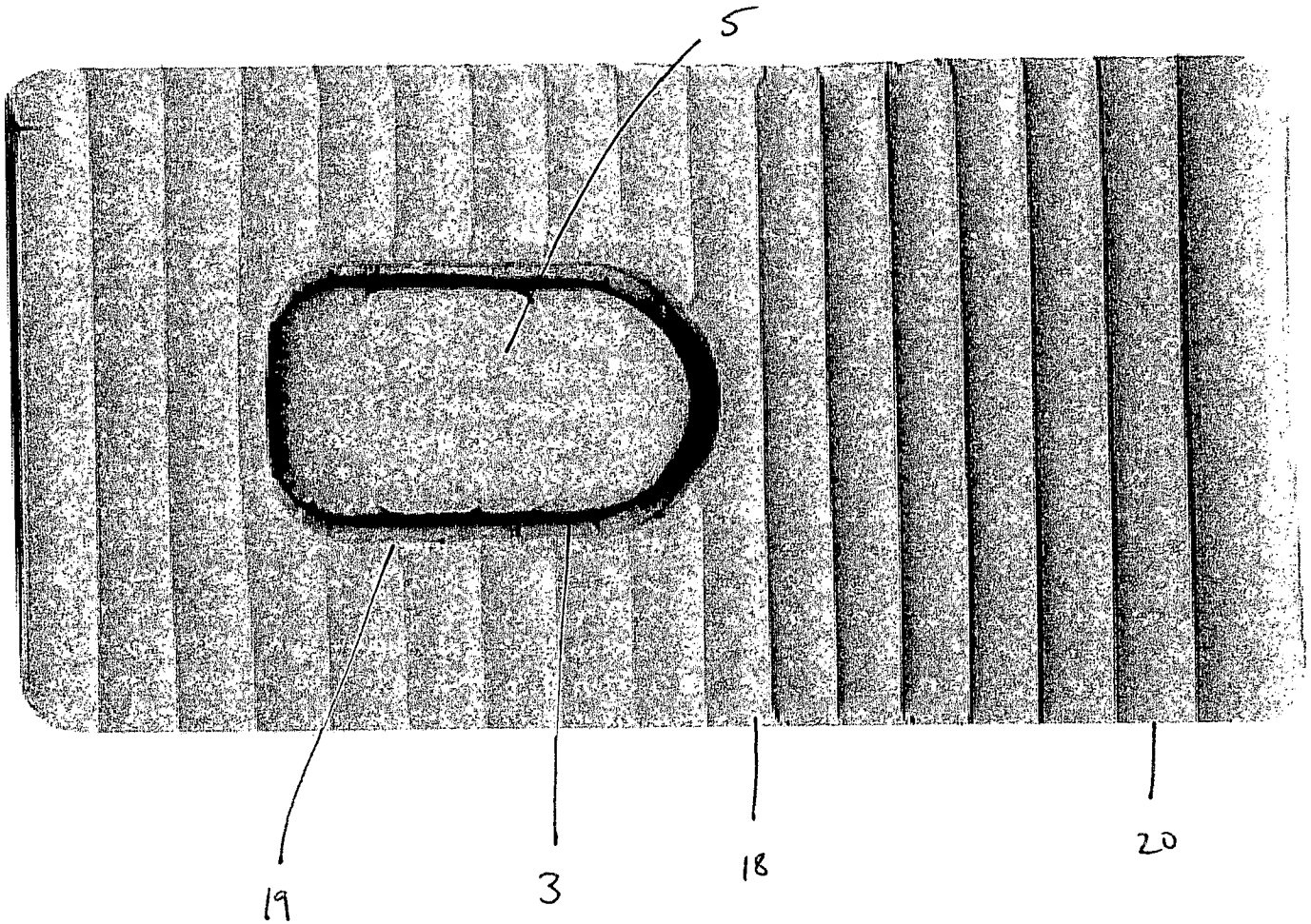
FIG. 6 is a top view of the bed system of FIG. 2.
Figure 7:
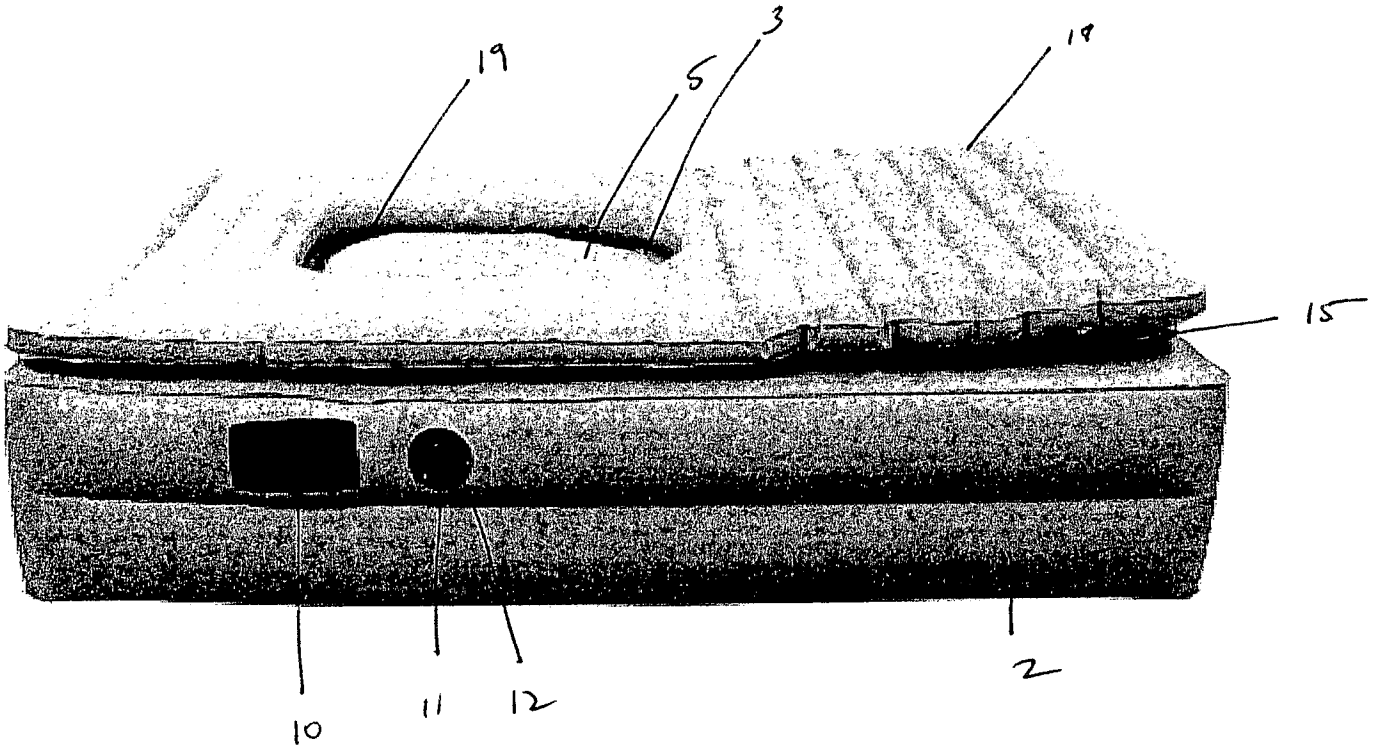
FIG. 7 is a side perspective view of the bed system of FIG. 2.

Referring to the Figures, disclosed is an inflatable bed system 1. The inflatable bed system is particularly well suited to being used as a mattress for sleep or rest during pregnancy or in other circumstances when a user's abdomen is particularly large or when a user needs to raise their legs.

The inflatable bed system 1 comprises a primary inflatable mattress section 2 which makes up the base of the mattress. The primary inflatable mattress section 2 is shaped as a rectangular prism and is sufficiently wide and deep to allow a user to comfortably rest thereon. The primary inflatable mattress section 2 is composed of any flexible and air impermeable material, for example high quality PVC. The surface has a soft velour finish. The inflatable bed system 1 is adapted to be filled with air.

The primary inflatable mattress section 2 includes an abdomen cavity 3. The abdomen cavity 3 is positioned centrally on the primary inflatable mattress section 2 and extends downwardly into the primary inflatable mattress section 2. The abdomen cavity 3 is positioned such that a user lying on their stomach would find their abdomen was naturally positioned within the abdomen cavity 3. The abdomen cavity 3 is sufficiently deep to allow a woman in the last trimester of her pregnancy to position her abdomen within the abdomen cavity 3.

A secondary inflatable section 5 is positioned within the cavity. The secondary inflatable section 5 is composed of the same material as the primary inflatable section 2 but is independently inflatable. The secondary inflatable section 5 is sized such that when inflated it substantially fills the abdomen cavity 3.

The inflation of the primary inflatable mattress section 2 and the secondary inflatable section 5 is controlled by a pump 10 which is positioned within the primary inflatable section. The pump 10 is connected with the primary inflatable mattress section 2 and the secondary inflatable section 5 via a valve 11. The valve 11 is controlled by a controller 12 positioned on the side of the primary inflatable mattress section 2. The controller 12 activates the valve 11 to direct air flow from the pump 10 into the selected inflatable section.

The pump 10 is controlled by a remote control 13 which is adapted to control the inflation and deflation of each of the inflatable sections. The pump is powered by the electrical mains through a power cord 25.

In a first embodiment as best shown in FIGS. 1 through 8, the inflatable bed system 1 includes one or more tertiary inflatable sections to further configure the profile of the bed under use control. In the illustrated form, one of the tertiary inflatable sections comprises a wedge shaped inflatable leg rest 15 which is positioned on the foot of the primary inflatable mattress section 2. When the leg rest 15 is inflated it allows a user to lie on her back on the inflatable bed system 1 while having her legs raised.

Figure 8:
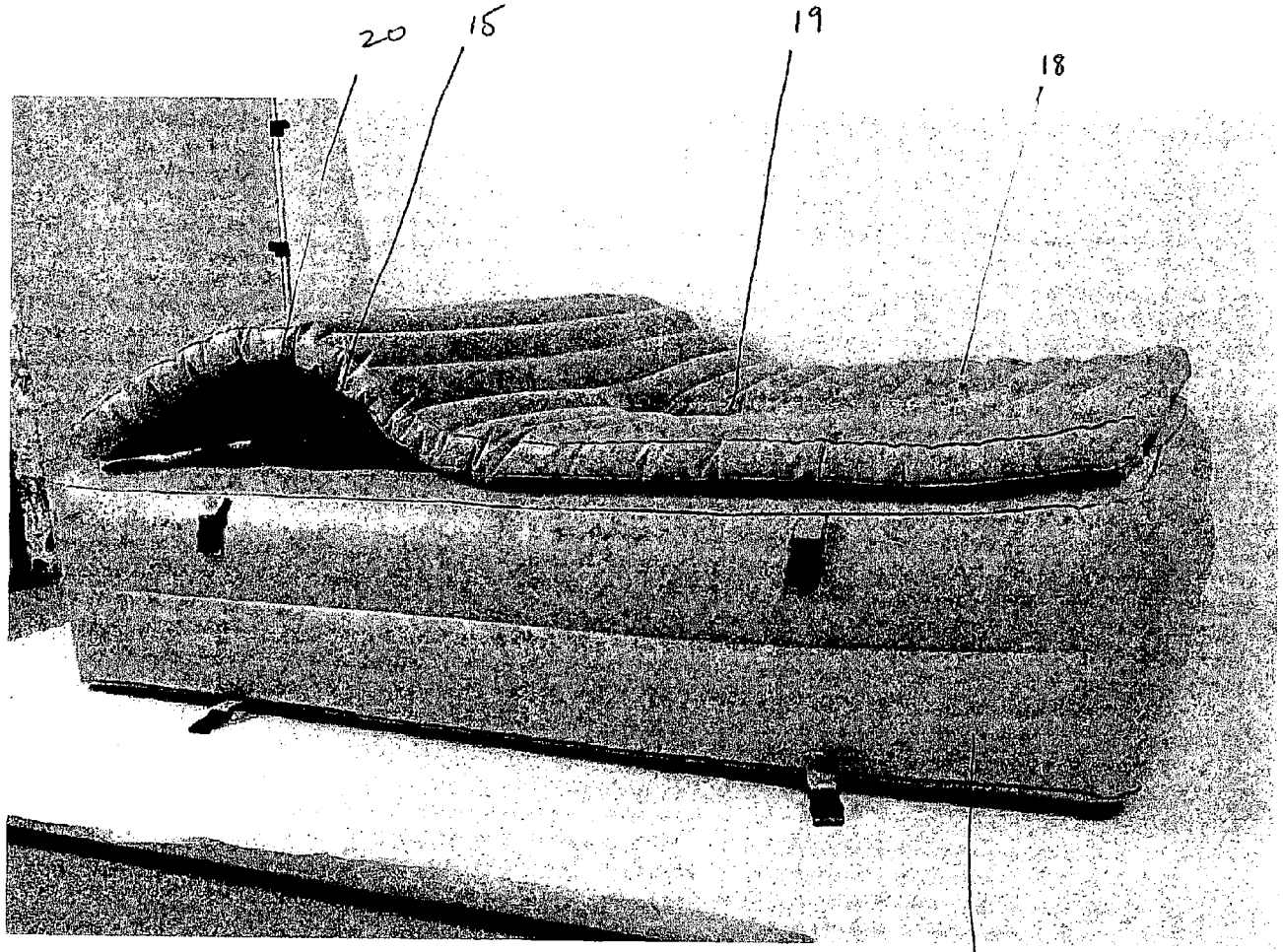
FIG. 8 is a side perspective view of the bed system of FIG. 2.

As best seen in FIG. 8, the wedge shaped inflatable leg rest 15 is moveable with respect to the inflatable mattress section 2 to allow for a user to position the leg rest 15 at a position that is most comfortable. For example, the leg rest 15 could be positioned to raise the feet of a user, or to simply raise the knees of the user. The leg rest 15 is inflatable and deflatable such that it can be utilised at varying heights as required by the user.

The inflation and deflation of the leg rest 15 is also controlled by the pump 10 which is activated by the remote control 13. The valve 11 can be positioned to direct air flow from the pump into or out of the leg rest 15.

In this embodiment, the inflatable bed system 1 further includes a surface layer 18. The surface layer 18 is composed of flocked material and is sufficiently comfortable to allow rest. The surface layer 18 includes a surface cavity 19 which extends through the surface layer 18. The surface cavity 19 is shaped and positioned such that it can be aligned with the abdomen cavity 3 in the inflatable primary mattress section 2.

The surface layer 18 also extends over the leg rest 15 such that upon inflation of the leg rest 15 the surface layer 18 is moved upwardly at the point where the leg rest 15 is positioned. The surface layer 18 is sufficiently flexible to allow it to fall comfortably over the leg rest 15 and sufficiently rigid to provide a consistent leg rest section 20 over the leg rest 15.

In one embodiment, as best shown in FIGS. 12 through 15, the leg rest section 20 over the leg rest 15 is attached with the surface layer 18 by means of a clip 23.

Figure 14:
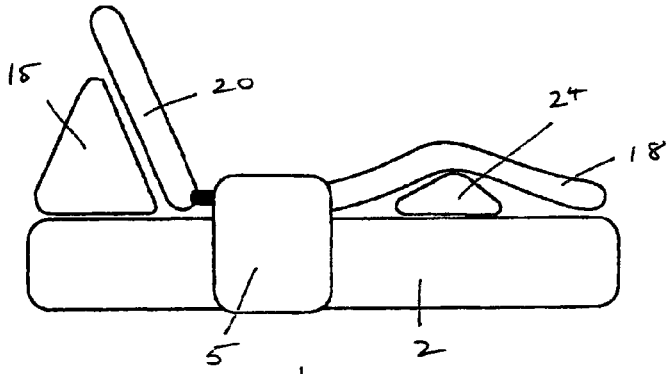
FIG. 14 is a cross-sectional view of the inflatable bed system of FIG. 12.
Figure 15:
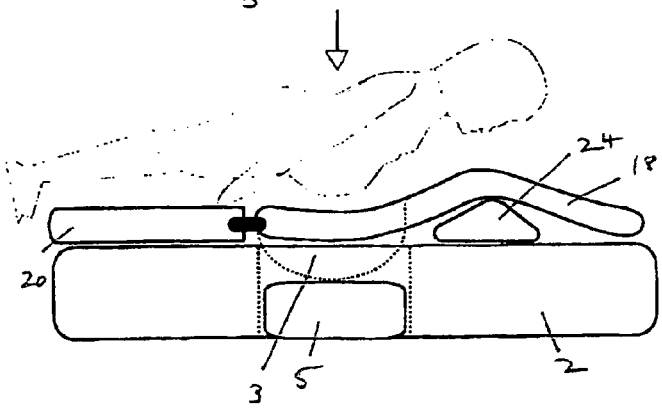
FIG. 15 is a cross-sectional view of the inflatable bed system of FIG. 12.
Figure 16:
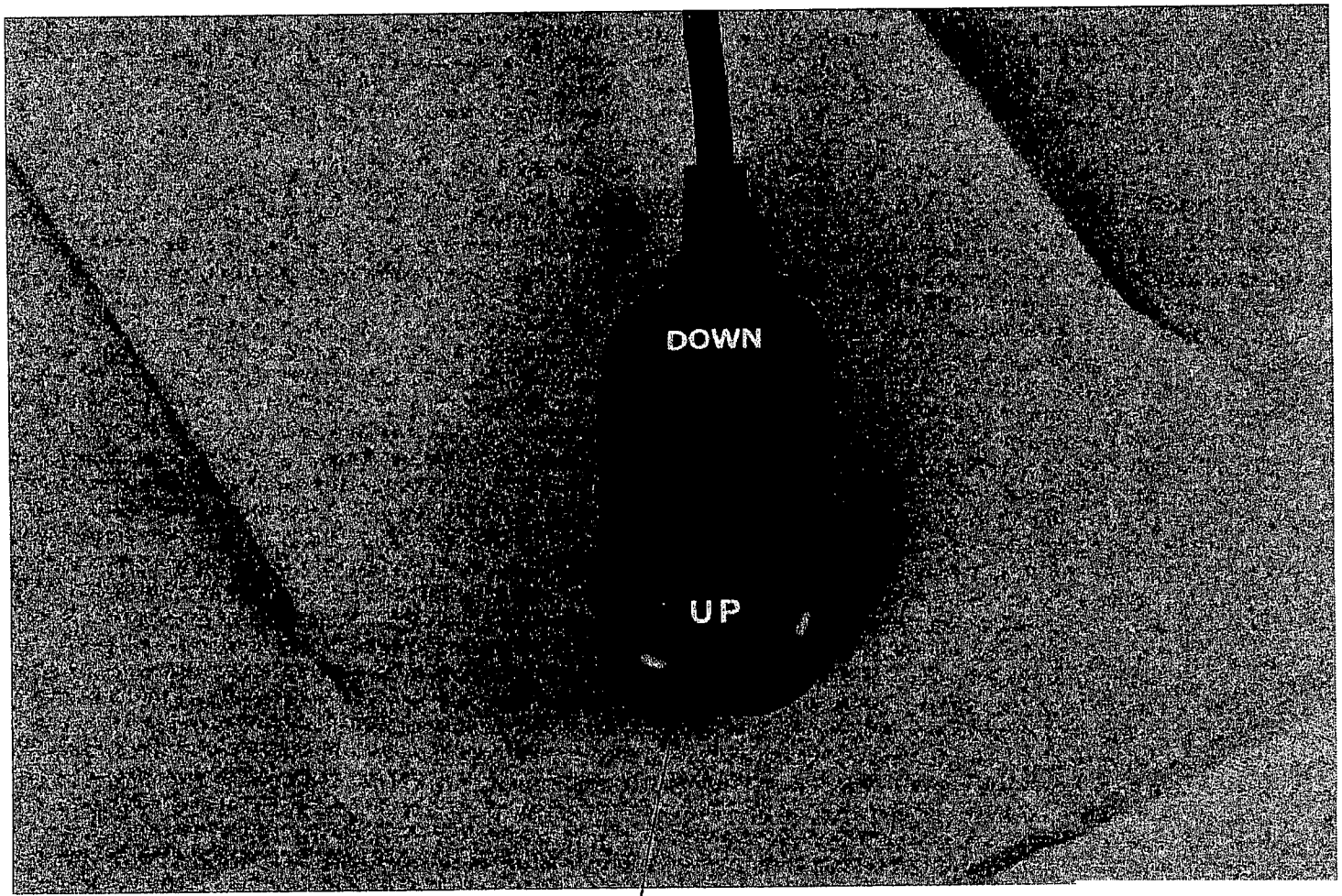
FIG. 16 is a top view of the remote control of one embodiment of the invention.
Figure 17:
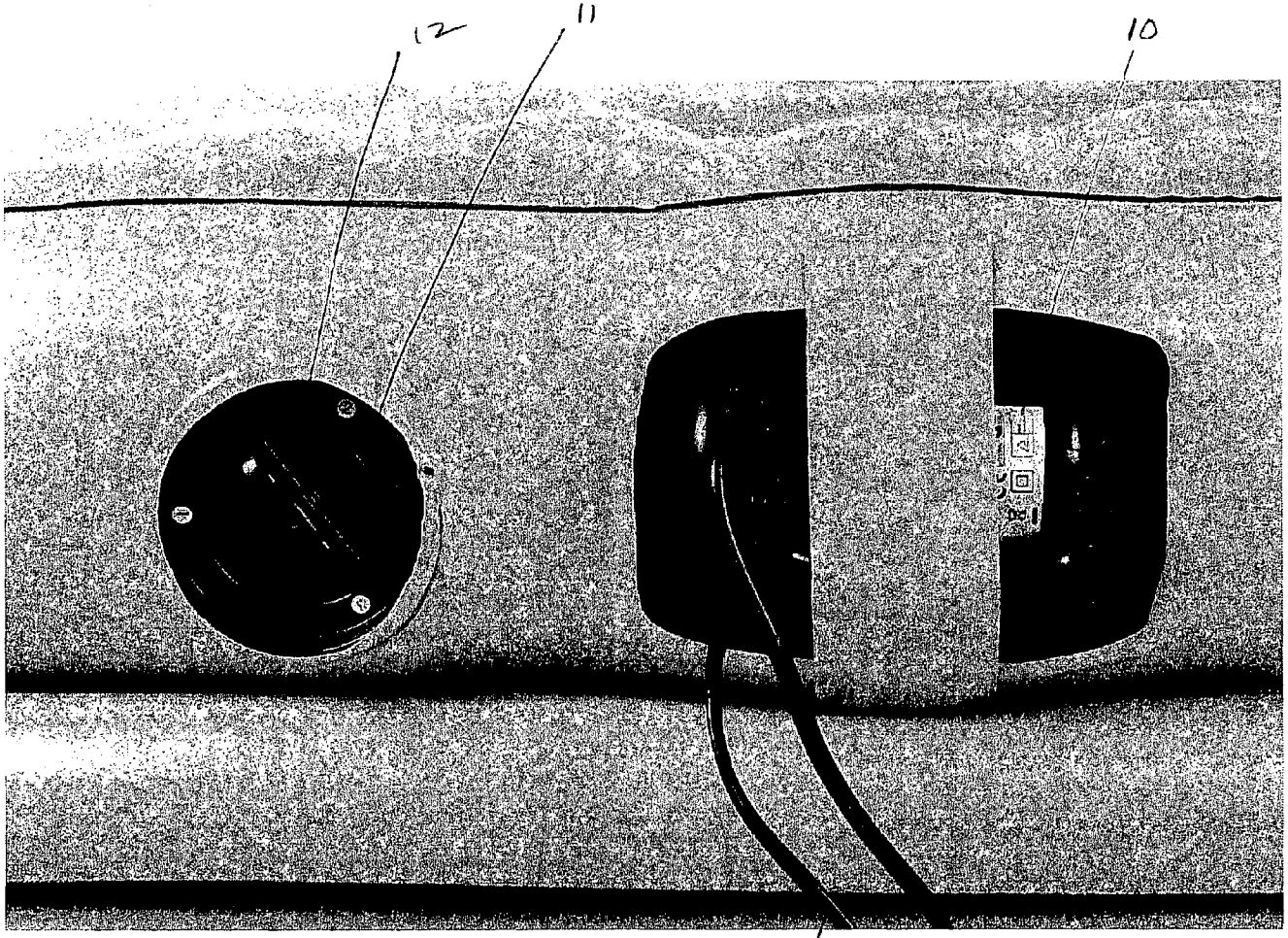
FIG. 17 is a side detail view of the valve and pump of one embodiment of the present invention.

In one embodiment as best shown in FIGS. 14 and 15, an additional pillow 24 can be positioned under the surface layer 18 to allow for comfortable resting on the back with the legs raised or on the front with the legs lowered.

In one embodiment the surface layer 18 is connected with the primary mattress section 2 by means of clips positioned on the primary mattress section 2.

In one embodiment the primary mattress section 2 includes concave breast sections 21 to allow a user to comfortable position her breasts when lying on her stomach.

Figure 9:
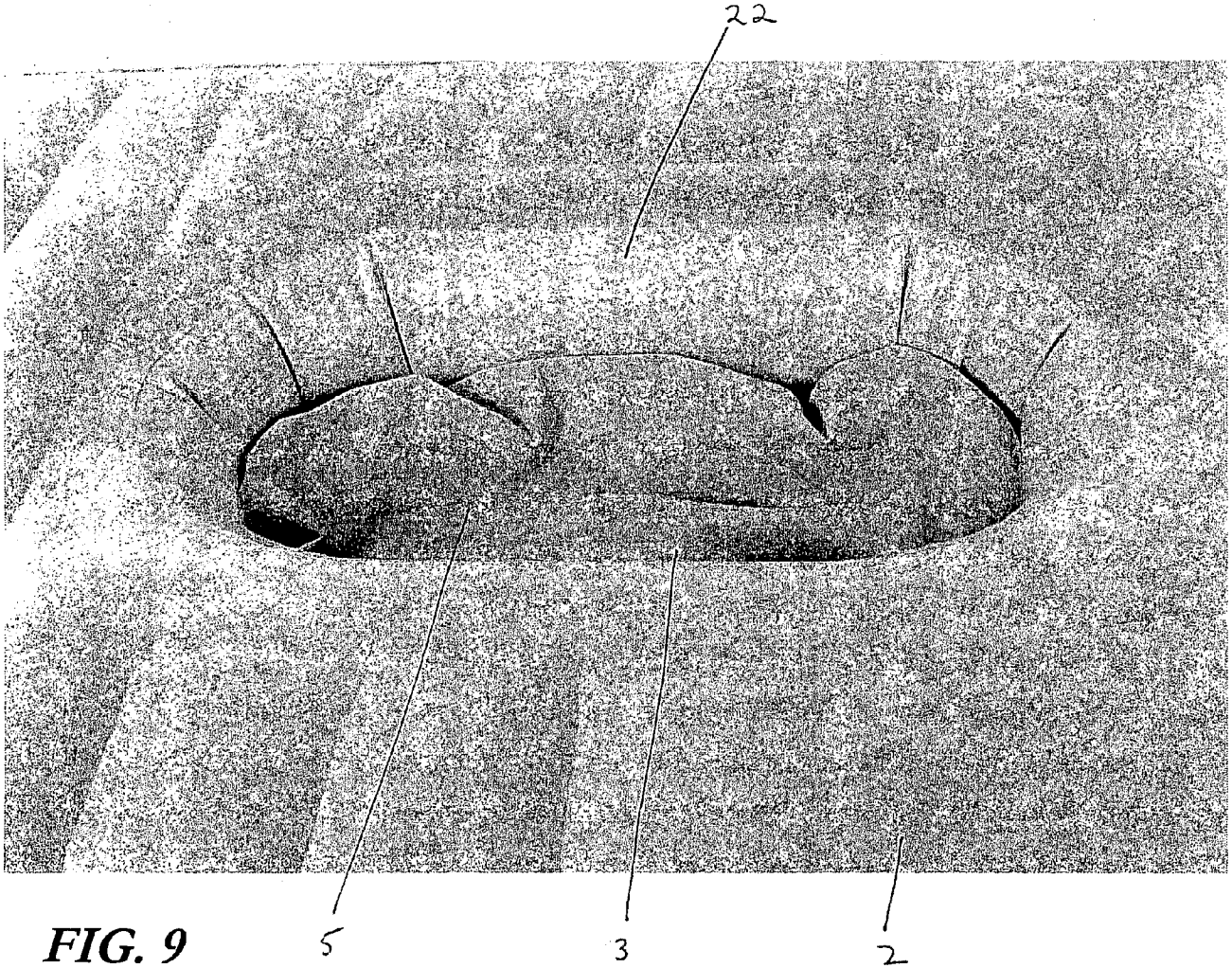
FIG. 9 is a top perspective view of detail of an inflatable bed system of a second embodiment of the present invention.
Figure 10:
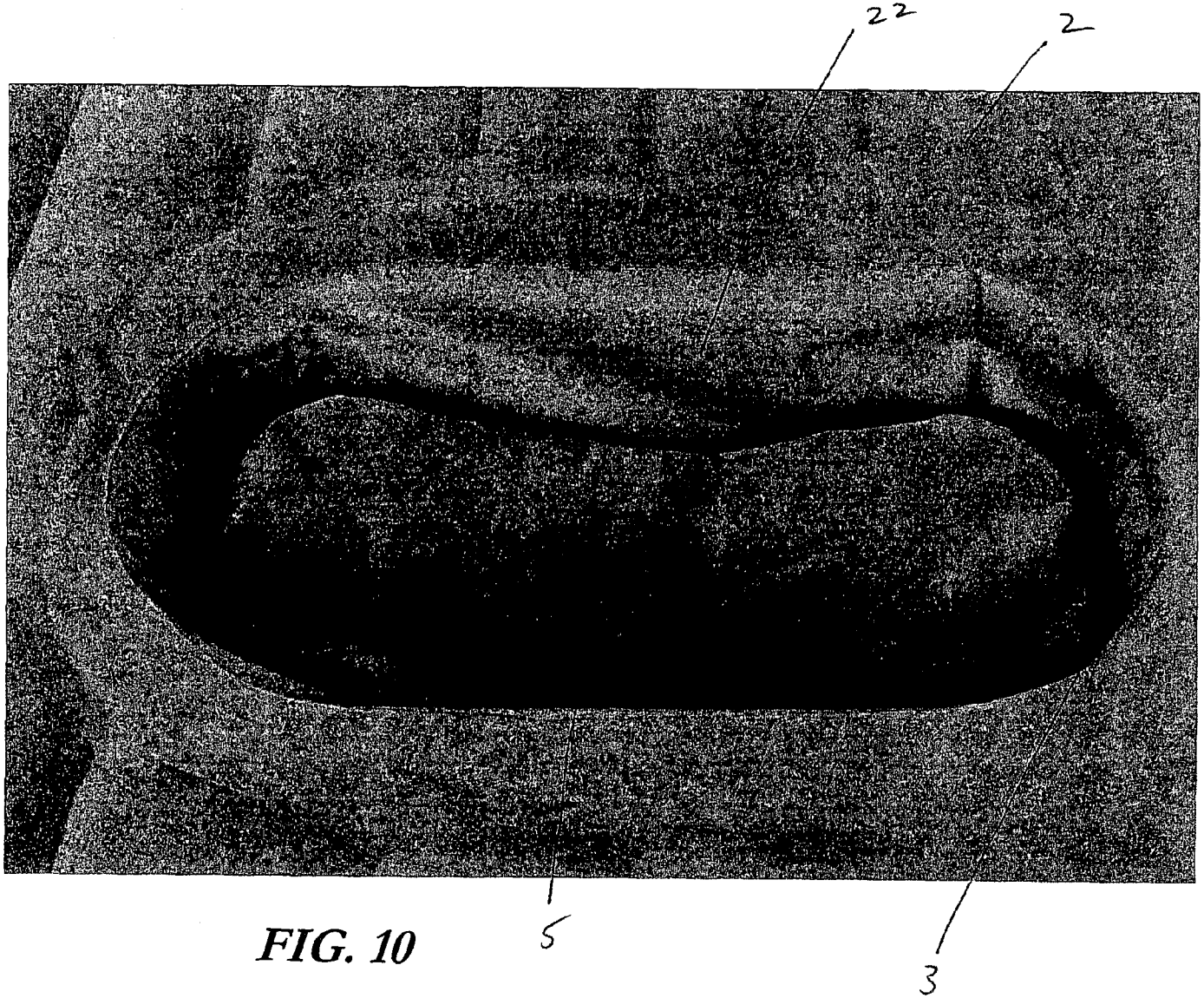
FIG. 10 is a top perspective view of detail of the bed system of FIG. 9.
Figure 11:
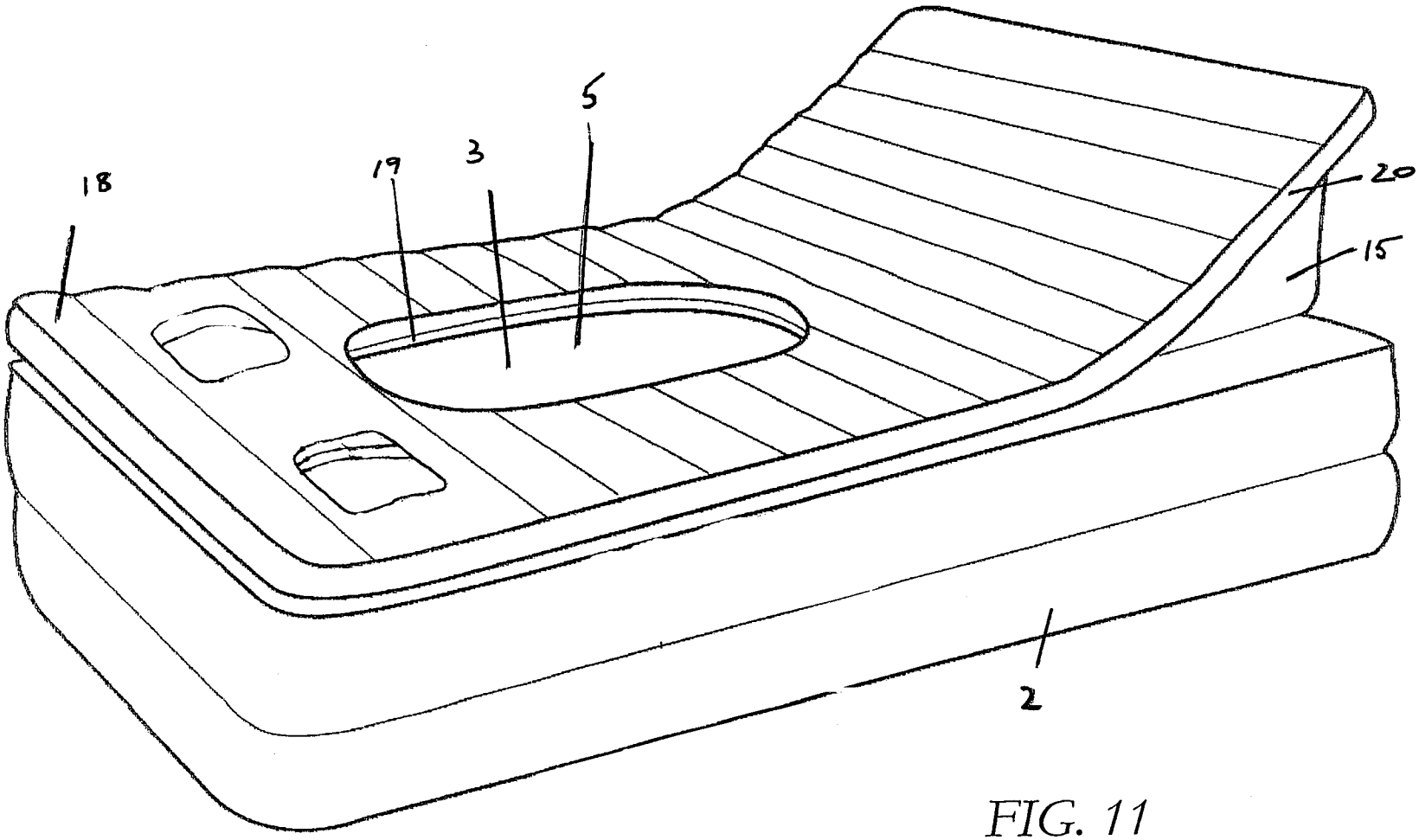
FIG. 11 is a perspective view of an inflatable bed system of a third embodiment of the present invention.
Figure 12:
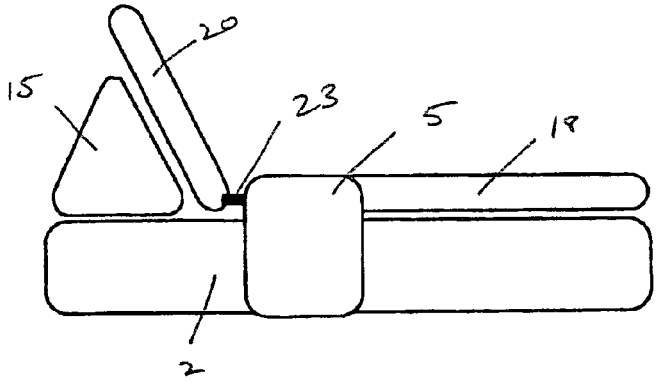
FIG. 12 is a side cross sectional view of an inflatable bed system of a fourth embodiment of the present invention.
Figure 13:
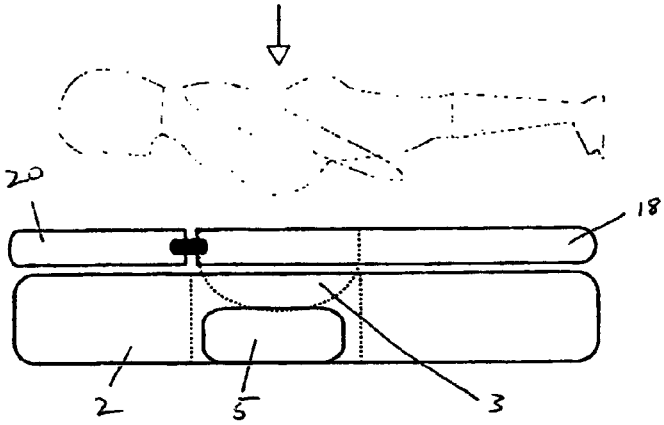
FIG. 13 is a cross-sectional view of the inflatable bed system of FIG. 12.

In a second preferred embodiment which is best shown in FIGS. 9 and 10, the inflatable bed system 1 further includes a tertiary inflatable system in the form of an inflatable ring 22 which is positioned to circle the periphery of the abdomen cavity 3 in primary mattress section 2. The inflatable ring 22 is independently inflatable by means of the pump 10.

The inflatable ring 22 circles the periphery of the abdomen cavity 3 such that the abdomen cavity 3 can be widened gently. The inflatable ring 22 further provides a gentle gradation on the sides of the abdomen cavity 3 which allows for the support of the abdomen within the abdomen cavity 3. The bed system 1 with the inflatable ring 22 can also provide to other features of the earlier embodiment including the inflatable leg rest 15.

The valve 11 is adapted such that it can direct air flow to or from the pump 10 into any one of the inflatable sections of the inflatable bed system 1. When the user selects on the valve controller 12 that the valve inflate or deflate the secondary inflatable section 5 within the abdomen cavity 3, the valve 11 directs air flow from the pump 10 into the secondary inflatable section 5. The remote control 13 for the pump 10 can then be utilised to accurately direct the necessary amount of air into the secondary inflatable section 5. This allows a user to lie on her stomach on the inflatable bed system 1 and to inflate the secondary inflatable section 5 within the abdomen cavity 3 such that her abdomen is comfortably supported within the abdomen cavity 3.

The user can then elect to inflate or deflate the inflatable ring 22 at the periphery of the abdomen cavity 3 to provide sufficient and comfortable support by selecting that section on the valve controller 12 and then utilising the remote control to allow the pump 10 to control the amount of air in the inflatable ring 22.

Alternatively or in addition to, a user can elect to inflate the leg rest 15. The user first inflates the secondary inflatable section 5 positioned within the abdomen cavity 3 completely, then selects the leg rest 15 with the valve controller 12. Lying on her back she utilises the remote control 13 to control the pump 10. The valve 11 directs air flow from the pump 10 into the leg rest 15 allowing the user to inflate the leg rest 15 to a comfortable level.

There is optional manual control to inflate or deflate each section of the inflatable bed system.

It is to be understood that a reference herein to a prior art document does not constitute an admission that the document forms part of the common general knowledge in the art in Australia or in any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An inflatable bed system, comprising:

a primary inflatable mattress section, having an upper surface and a centrally located abdomen cavity extending downwardly from the upper surface, the cavity being shaped to allow a user's abdomen to be positioned therein;

a secondary inflatable section, the secondary section being structurally integral with and independently inflatable from the primary inflatable mattress section and positioned inside the cavity, the secondary inflatable section being movable between an inflated configuration in which it substantially fills the abdomen cavity and a deflated configuration in which the cavity extends downwardly to an upper face of the secondary inflatable section; and a tertiary inflatable section positioned within the cavity about a periphery of the second inflatable section and being movable between an inflated configuration and a deflated configuration so as to vary a diameter of the cavity to be filled by the secondary inflatable section, the tertiary inflatable section configured to support the user's abdomen in at least the inflated configuration.

2. An inflatable bed system as defined in claim 1, wherein the cavity is oval and the tertiary inflatable section comprises an oval loop.

3. An inflatable bed system as defined in claim 1, further comprising at least one wedge-shaped tertiary inflatable section positioned at the foot of the primary inflatable mattress section.

4. An inflatable bed system as defined in claim 1, having a surface layer positioned above the primary inflatable mattress section.

5. An inflatable bed system as defined in claim 4, wherein the surface layer extends over the primary inflatable mattress section and includes a surface cavity adapted to align with the abdomen cavity.

6. An inflatable bed system as defined in claim 4, wherein the surface layer is composed of flocking.

7. An inflatable bed system as defined in claim 1, further comprising a valve which directs the movement of air into each of the inflatable sections, and a pump operatively connected to the valve.

8. An inflatable bed system as defined in claim 7, wherein the valve is adapted to direct air flow from the pump into a selected inflatable section upon selection of the inflatable section by a user.

9. An inflatable bed system as defined in claim 7, wherein the valve is controlled manually.

10. An inflatable bed system as defined in claim 7, wherein the pump is activated by a remote control.

11. An inflatable bed system as defined in claim 1, wherein the primary, secondary, and tertiary sections are controlled by a single pump.

12. An inflatable bed system, comprising:

a primary inflatable mattress section, having an upper surface and a centrally located abdomen cavity extending downwardly from the upper surface, the cavity being shaped to allow a user's abdomen to be positioned therein; and a secondary inflatable section, the secondary section being structurally integral with and independently inflatable from the primary inflatable mattress section and positioned inside the cavity, the secondary inflatable section being movable between an inflated configuration in which it substantially fills the abdomen cavity and a deflated configuration in which the cavity extends downwardly to an upper face of the secondary inflatable section, wherein the primary inflatable mattress section forms a base of the inflatable bed system, and the secondary inflatable section is positioned inside the cavity so as to be arranged over the primary inflatable mattress section.

13. An inflatable bed system as defined in claim 12, further comprising a tertiary inflatable section which is positioned around at least a portion of a periphery of the cavity.

14. An inflatable bed system as defined in claim 13, wherein the cavity is oval and the tertiary inflatable section comprises an oval loop.

15. An inflatable bed system as defined in claim 12, further comprising at least one wedge-shaped tertiary inflatable section positioned at the foot of the primary inflatable mattress section.

16. An inflatable bed system as defined in claim 12, having a surface layer positioned above the primary inflatable mattress section.

17. An inflatable bed system as defined in claim 16, wherein the surface layer extends over the primary inflatable mattress section and includes a surface cavity adapted to align with the abdomen cavity.

18. An inflatable bed system as defined in claim 16, wherein the surface layer is composed of flocking.

19. An inflatable bed system as defined in claim 12, further comprising a valve which directs the movement of air into each of the inflatable sections, and a pump operatively connected to the valve.

20. An inflatable bed system as defined in claim 19, wherein the valve is adapted to direct air flow from the pump into a selected inflatable section upon selection of the inflatable section by a user.

* * * * *